US011037442B2

(12) United States Patent
Sekiguchi

(10) Patent No.: US 11,037,442 B2
(45) Date of Patent: Jun. 15, 2021

(54) SYSTEM, SYSTEM CONTROL METHOD, AND INFORMATION PROVIDING SERVER

(71) Applicant: SHARP KABUSHIKI KAISHA, Sakai (JP)

(72) Inventor: Yoshihisa Sekiguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/747,292

(22) Filed: Jan. 20, 2020

(65) Prior Publication Data

US 2020/0242927 A1 Jul. 30, 2020

Related U.S. Application Data

(60) Provisional application No. 62/796,937, filed on Jan. 25, 2019.

(51) Int. Cl.
*G08G 1/09* (2006.01)
*G08G 1/0967* (2006.01)
*G08G 1/01* (2006.01)

(52) U.S. Cl.
CPC ..... *G08G 1/096716* (2013.01); *G08G 1/0112* (2013.01); *G08G 1/0133* (2013.01); *G08G 1/0141* (2013.01); *G08G 1/096775* (2013.01)

(58) Field of Classification Search
CPC ..... G08G 1/096716; B60Q 9/008
USPC ..... 340/905, 907, 908, 436, 438, 989, 903, 340/425.5, 937
See application file for complete search history.

(56) References Cited

U.S. PATENT DOCUMENTS

| | | | | |
|---|---|---|---|---|
| 10,279,733 | B1 * | 5/2019 | Danielson | B60Q 1/503 |
| 2004/0090314 | A1 * | 5/2004 | Iwamoto | B60Q 9/008 340/425.5 |
| 2013/0069802 | A1 * | 3/2013 | Foghel | G08G 1/205 340/989 |
| 2018/0197415 | A1 | 7/2018 | Kurata | |
| 2018/0357484 | A1 | 12/2018 | Omata | |
| 2020/0090502 | A1 * | 3/2020 | Yang | G08G 1/0141 |

FOREIGN PATENT DOCUMENTS

| | | | |
|---|---|---|---|
| JP | 2003-123185 | A | 4/2003 |
| JP | 2014-154004 | A | 8/2014 |
| JP | 2017-138694 | A | 8/2017 |
| JP | 2018-112892 | A | 7/2018 |

* cited by examiner

*Primary Examiner* — Tai T Nguyen
(74) *Attorney, Agent, or Firm* — ScienBiziP, P.C.

(57) ABSTRACT

Provided is a cloud server including an information acquisition unit that acquires location information indicating a location where dangerous driving occurred, a dangerous road determination unit that generates dangerous road information indicating a dangerous area specified according to a plurality of pieces of location information, and a dangerous road information transmission control unit that transmits dangerous road information to a display device.

15 Claims, 11 Drawing Sheets

SYSTEM, SYSTEM CONTROL METHOD, AND INFORMATION PROVIDING SERVER

BACKGROUND

1. Field

The present disclosure relates to a system for assisting driving of an automobile, a system control method for assisting driving of the automobile, and an information providing server for assisting driving of the automobile.

2. Description of the Related Art

Currently, there is a demand for technology for suppressing the occurrence of a serious accident due to dangerous driving, and technology for detecting dangerous driving of a host vehicle is known as related art technology. For example, Japanese Unexamined Patent Application Publication No. 2018-112892 discloses technology aimed at improving preventive safety in which a driver of the own vehicle performs self-defense by paying attention to whether or not drivers of the other vehicles are habitual violent drivers.

Specifically, a driving assistance device disclosed in Japanese Unexamined Patent Application Publication No. 2018-112892 captures images of other vehicles that travel behind the host vehicle and determines whether or not the other vehicles are in violent driving states with respect to the host vehicle based on the captured images. Further, when the violent driving state is continuous, information on the other vehicles are provided to the driver of the host vehicle.

However, the technology as disclosed in Japanese Unexamined Patent Application Publication No. 2018-112892 is not technology based on the viewpoint of avoiding the driver of the vehicle from becoming a target of violent driving in advance. Therefore, there arises a problem that it is hard to avoid a driver from being damaged by dangerous driving in advance.

One aspect of the present disclosure has been made in view of the above problems, and the purpose is to allow a driver to recognize a place where dangerous driving is likely to occur, and to reduce the driver's damage from dangerous driving.

SUMMARY (1) According to an aspect of the present disclosure, there is provided a system including: an information processing device that acquires location information indicating a location where dangerous driving occurred, which is determined from imaged data obtained by imaging a traveling vehicle; an information providing server that generates dangerous area information indicating a dangerous area specified according to a plurality of pieces of the location information acquired from the information processing device; and a display device that displays the dangerous area indicated by the dangerous area information on a map.

(8) According to another aspect of the present disclosure, there is provided a system control method including: a location information acquisition step for acquiring location information indicating a location where dangerous driving occurred that is determined from imaged data obtained by imaging a traveling vehicle; a generation step for generating dangerous area information indicating a dangerous area specified according to a plurality of pieces of the location information acquired in the location information acquisition step; and a display step for displaying a map on which the dangerous area is indicated using the dangerous area information.

(15) According to still another aspect of the present disclosure, there is provided an information providing server including: an acquisition unit that acquires location information indicating a location where dangerous driving occurred; a dangerous area specification unit that generates dangerous area information indicating a dangerous area specified according to a plurality of pieces of the location information; and a transmission unit that transmits the dangerous area information to an external device.

DESCRIPTION OF THE EMBODIMENTS

Embodiment 1

Dangerous Area Display System 1

Figure 2:
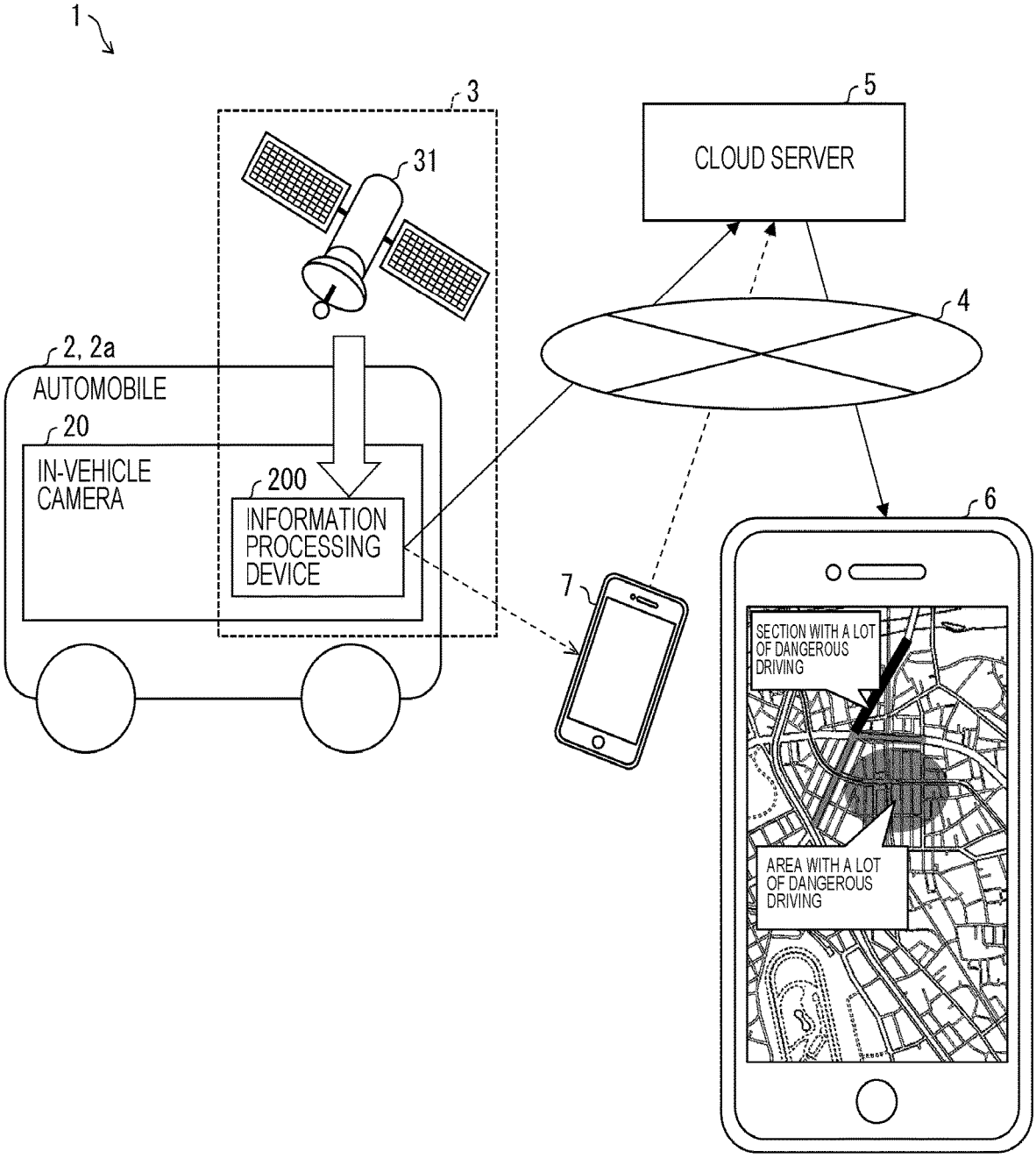
FIG. 2 is a diagram showing an example of a dangerous area display system 1 according to Embodiment 1 of the present disclosure.

FIG. 2 is a diagram showing an example of a dangerous area display system 1 according to Embodiment 1. The dangerous area display system 1 specifies a dangerous area based on location information indicating a location where dangerous driving occurred, and displays the dangerous area on a map. As shown in FIG. 2, the dangerous area display system 1 includes an information processing device 200, a cloud server (information providing server) 5, and a display device 6.

Figure 3:
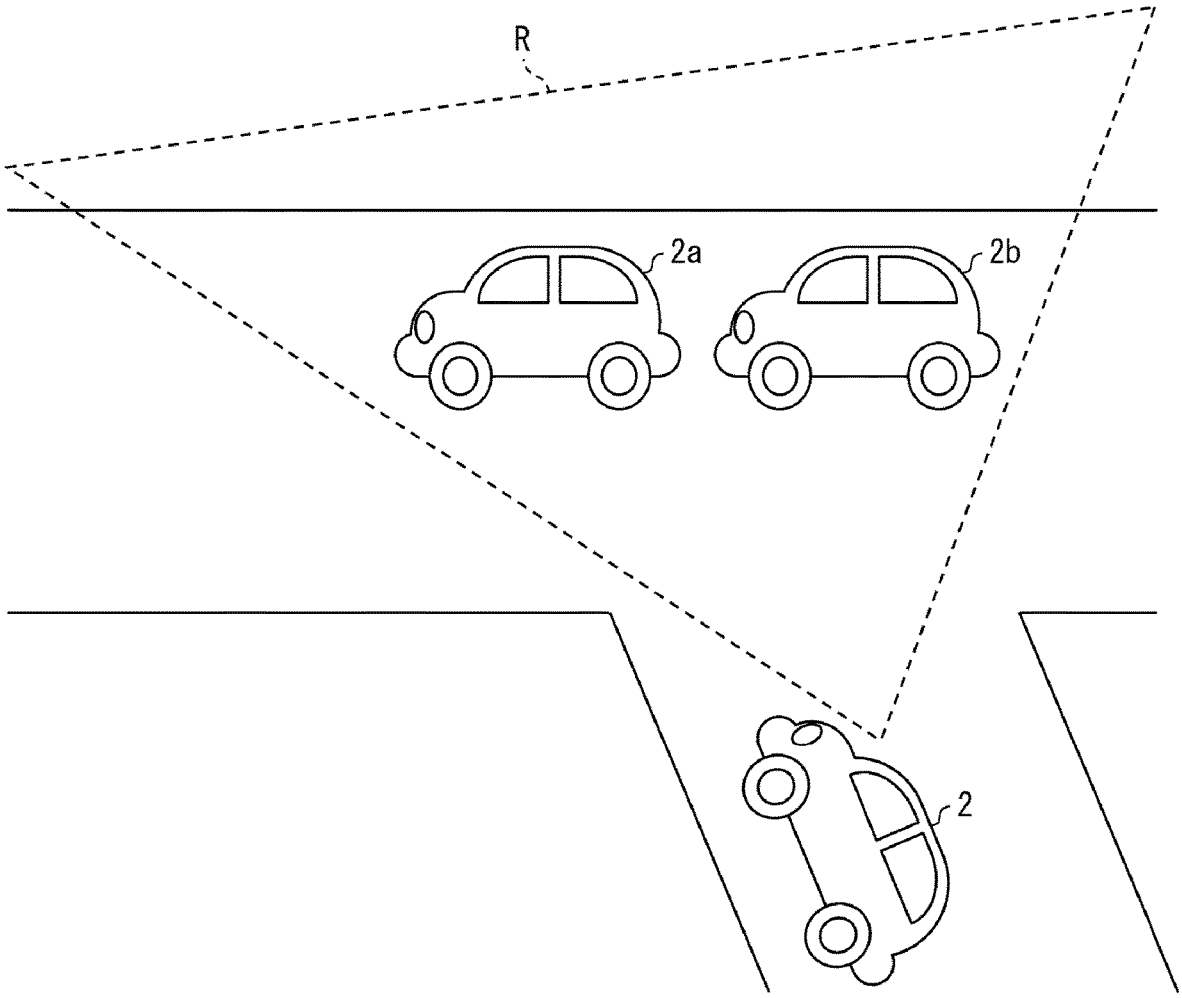
FIG. 3 is a diagram showing an example of an image capturing range R by an in-vehicle camera according to Embodiment 1 of the present disclosure.

The information processing device 200 determines whether or not dangerous driving occurred based on imaged data obtained by imaging a traveling vehicle. When the information processing device 200 determines that the dangerous driving occurred, the information processing device 200 acquires location information indicating a location where the dangerous driving occurred. In the example shown in FIG. 2, the information processing device 200 is mounted on an in-vehicle camera of an automobile 2 or 2*a*. In the present embodiment, the automobile 2 is a vehicle other than an automobile that is damaged by dangerous driving. The automobile 2*a* is an automobile that is damaged by dangerous driving. FIG. 3 is a diagram showing an example of an image capturing range R by the in-vehicle camera 20 mounted on the automobile 2. In the example shown in FIG. 3, an example in which the in-vehicle camera 20 mounted on the automobile 2 images a violent driving that is dangerous driving by an automobile 2*b* with respect to the automobile 2*a*, is shown. Further, an image capturing device for imaging dangerous driving and the information processing device 200 may be installed on a utility pole, a building, or the like.

In other words, the imaged data is imaged data captured by at least one of an image capturing device installed in a vehicle damaged by dangerous driving and an image capturing device installed in a location other than the vehicle damaged by the dangerous driving.

When the image capturing device for imaging dangerous driving and the information processing device 200 are mounted on an automobile that is damaged by the dangerous driving, it is possible to image the detailed behavior of the vehicle that is performing the dangerous driving. Further, when the image capturing device for imaging dangerous driving and the information processing device 200 are installed at the location other than the automobile that is damaged by the dangerous driving, the entire vehicle that is performing the dangerous driving can be captured. According to the above configuration, the precision of determination of the presence or absence of an occurrence of dangerous driving can be improved.

The information processing device 200 determines whether or not dangerous driving occurred based on imaged data captured by the camera 21 included in the in-vehicle camera. In the example shown in FIG. 2, when the information processing device 200 determines that the dangerous driving occurred, the information processing device 200 receives a global positioning system (GPS) signal or the like from a navigation satellite 31 using a satellite navigation system 3 to acquire the location information.

The information processing device 200 outputs the acquired location information to a cloud server 5. For example, a dangerous area display system 1 includes a plurality of information processing devices 200, and a cloud server 5 receives location information acquired by each information processing device 200.

The cloud server 5 specifies a dangerous area (a section with a lot of dangerous driving and an area with a lot of dangerous driving) according to a plurality of pieces of location information received from the information processing device 200, and generates dangerous area information indicating the dangerous area. The cloud server 5 outputs the dangerous area information to the display device 6. The display device 6 displays the dangerous area indicated by the dangerous area information on a map.

For example, the information processing device 200, the cloud server 5, and the display device 6 may be connected to each other in communication via a wide area communication network 4. Further, the information processing device 200 may communicate with the cloud server 5 via a relay device such as a smartphone 7. The information processing device 200 and the smartphone 7 may be connected to each other in communication via a short-distance communication network such as Bluetooth (registered trademark).

According to the configuration, a user can recognize a dangerous area where dangerous driving is likely to occur by confirming the dangerous area displayed on the display device 6. For example, the user avoids passing through areas where dangerous driving is likely to occur, so that damage from dangerous driving by other vehicles can be reduced.

Configuration of in-Vehicle Camera 20

Figure 4:
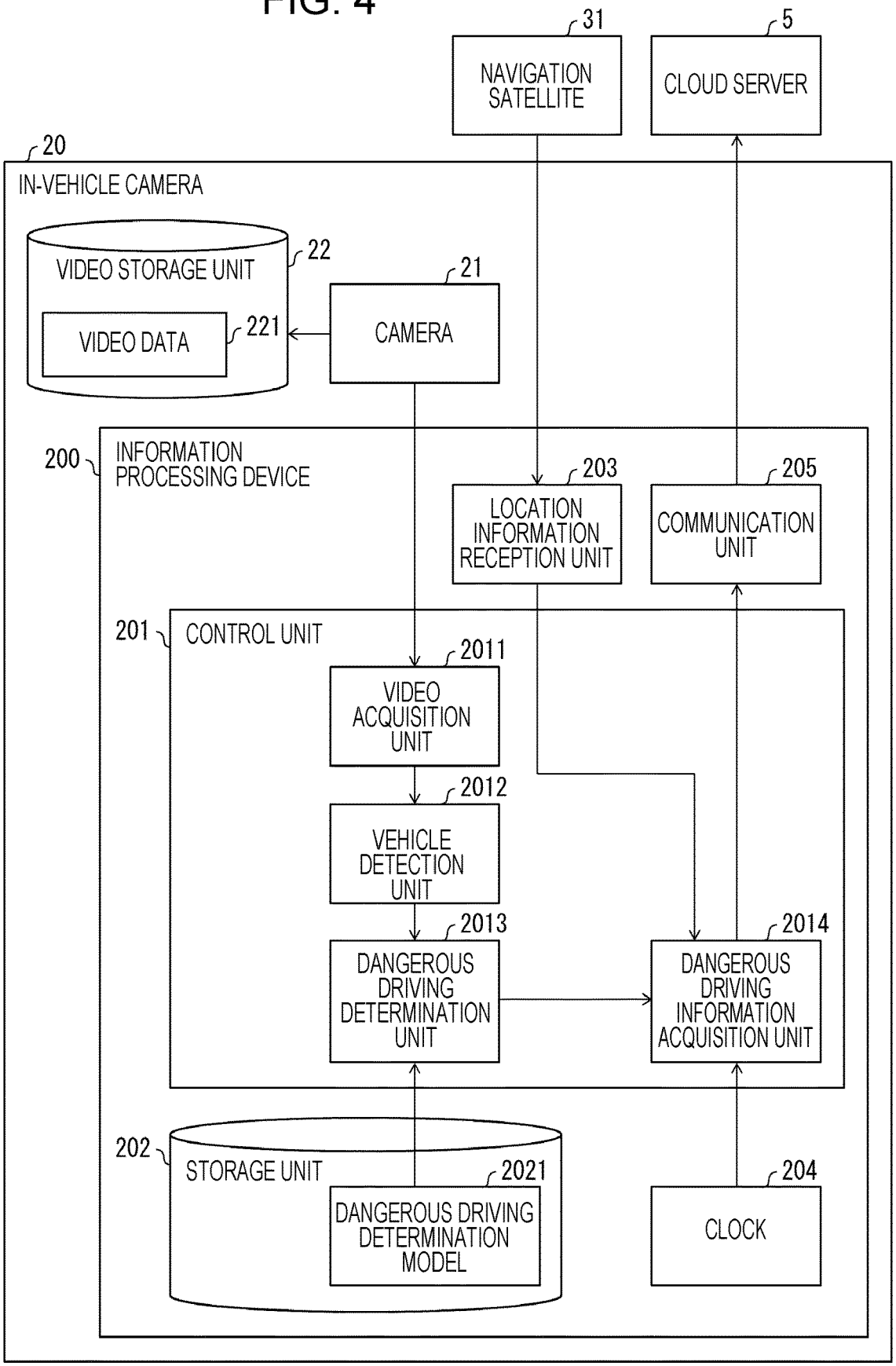
FIG. 4 is a block diagram showing an example of a major part configuration of the in-vehicle camera and an information processing device according to Embodiment 1 of the present disclosure.

Next, an example of the configuration of the in-vehicle camera 20 will be described. FIG. 4 is a block diagram showing an example of a major part configuration of the in-vehicle camera 20 and the information processing device 200. As shown in FIG. 4, the in-vehicle camera 20 includes a camera 21, a video storage unit 22, and an information processing device 200.

The in-vehicle camera 20 may be, for example, a drive recorder, a smartphone, or the like, and is not particularly limited as long as it can image the surroundings of an automobile.

The camera 21 images the surroundings of the automobile on which the in-vehicle camera 20 is mounted. For example, a complementary metal oxide semiconductor (CMOS) image sensor, a changed coupled device (CCD) image sensor, or the like may be applied to the camera 21.

The video storage unit 22 stores video data (imaged data) captured by the camera 21. For example, a video used for a determination of the dangerous driving by the information processing device 200 may be used for the user to visually recognize the dangerous driving after the determination. Further, only video data for a predetermined length of time including a video at the time when it is determined that dangerous driving occurred may be stored in the video storage unit 22.

Information Processing Device 200

As shown in FIG. 4, the information processing device 200 includes a control unit 201, a storage unit 202, a location information reception unit 203, a clock 204, and a communication unit 205.

Control Unit 201

The control unit 201 includes a central processing unit (CPU), a random access memory (RAM), a read only memory (ROM), and the like, and controls each component according to information processing. The control unit 201 includes a video acquisition unit 2011, a vehicle detection unit 2012, a dangerous driving determination unit 2013, and a dangerous driving information acquisition unit 2014.

Video Acquisition Unit 2011

The video acquisition unit 2011 acquires video data captured by the camera 21 and outputs the video data to the vehicle detection unit 2012.

Vehicle Detection Unit 2012

The vehicle detection unit 2012 detects a vehicle shown in a video captured by the camera 21. The vehicle detection unit 2012 only desires to be able to detect the vehicle from the video, and a detection method is not particularly limited. For example, the vehicle detection unit 2012 may detect the vehicle from the video by pattern recognition or the like.

Dangerous Driving Determination Unit 2013

The dangerous driving determination unit 2013 determines whether or not the vehicle detected by the vehicle detection unit 2012 is performing dangerous driving based on a dangerous driving determination model 2021 stored in the storage unit 202. When the dangerous driving determination unit 2013 determines that the vehicle detected by the vehicle detection unit 2012 is performing the dangerous driving, the dangerous driving determination unit 2013 outputs a signal indicating that the dangerous driving occurred, to the dangerous driving information acquisition unit 2014.

Dangerous Driving Determination Model 2021

Here, a dangerous driving determination model 2021 will be described. In the present embodiment, the information processing device 200 may generate a dangerous driving determination model 2021 that is a teacher model by machine learning. A known algorithm such as deep learning, which is known technology, may be used for the machine learning.

Specifically, a positive example of dangerous driving is captured in advance using the camera 21 or the like, and the dangerous driving determination model 2021 is generated by executing the machine learning using the corresponding imaged data. For example, the information processing device 200 is configured to model a case where an inter-vehicle distance of a vehicle shown in a video is equal to or less than a predetermined distance as a positive example of violent driving. In a case where the automobile damaged by dangerous driving is a host vehicle, the "inter-vehicle distance" is an inter-vehicle distance between the host vehicle and another vehicle shown in the video. Further, in a case where the automobile damaged by dangerous driving is a vehicle other than the host vehicle, the above-mentioned "inter-vehicle distance" is an inter-vehicle distance between a first other vehicle shown in the video and a second other vehicle shown in a different video from the first other vehicle.

The information processing device 200 may generate a teacher model that is a dangerous driving determination model 2021 for each type of dangerous driving. For example, the information processing device 200 is configured to model positive examples of driving such as meandering driving, sudden steering, speed limit excess, and the like as types of dangerous driving based on predetermined criteria.

That is, the dangerous driving determination unit 2013 determines the type of dangerous driving from the imaged data. The dangerous driving determination unit 2013 may output a signal indicating the determined type of dangerous driving to the dangerous driving information acquisition unit 2014.

Dangerous Driving Information Acquisition Unit 2014

When the dangerous driving information acquisition unit 2014 receives a signal indicating that the dangerous driving occurred from the dangerous driving determination unit 2013, the dangerous driving information acquisition unit 2014 receives, for example, a GPS signal as location information based on the satellite navigation system via the location information reception unit 203. Thereby, the longitude and latitude on the earth can be acquired as location information indicating the current location. The location information is handled as location information indicating a location where the dangerous driving occurred.

When the dangerous driving information acquisition unit 2014 receives a signal indicating that dangerous driving occurred from the dangerous driving determination unit 2013, the dangerous driving information acquisition unit 2014 acquires time information indicating the date-and-time at the current time from the clock 204. The time information is handled as time information indicating the date-and-time when the dangerous driving occurred.

The dangerous driving information acquisition unit 2014 outputs a signal indicating the location information, time information, and type of dangerous driving to the cloud server 5 via the communication unit 205. Note that the location information, time information, and signal indicating the type of dangerous driving may be transmitted at predetermined intervals, or may be transmitted when an engine of the automobile on which the in-vehicle camera 20 is mounted is turned off.

Location Information Reception Unit 203

A GPS signal or the like is received as the location information based on the satellite navigation system, and the signal is output to the dangerous driving information acquisition unit 2014.

Clock 204

The clock 204 measures the date-and-time. According to the instruction of the dangerous driving information acquisition unit 2014, the measured date-and-time is output to the dangerous driving information acquisition unit 2014.

Communication Unit 205

The communication unit 205 communicates with an external device via a wide area communication network 4 or the like. In the present embodiment, in particular, the communication unit 205 communicates with the cloud server 5.

Configuration of Cloud Server 5

Figure 1:
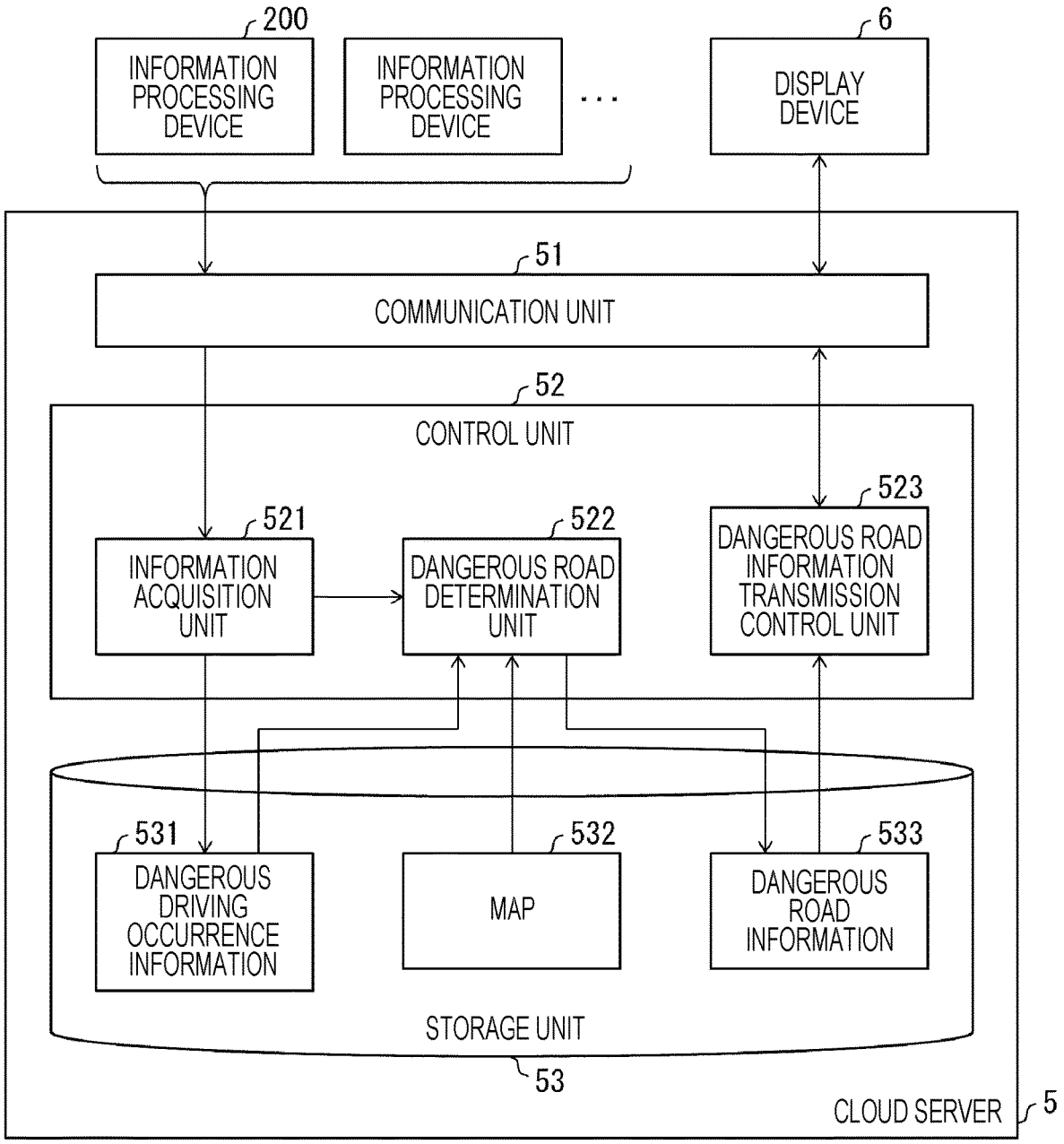
FIG. 1 is a block diagram showing an example of a major part configuration of a cloud server according to Embodiment 1 of the present disclosure.

Next, the configuration of the cloud server 5 will be described. FIG. 1 is a block diagram showing an example of a major part configuration of the cloud server 5. As shown in FIG. 1, the cloud server 5 includes a communication unit 51, a control unit 52, and a storage unit 53.

Communication Unit 51

The communication unit 51 communicates with an external device via a wide area communication network 4 or the like. In the present embodiment, in particular, the communication unit 51 communicates with a plurality of information processing devices 200 and the display device 6.

Control Unit 52

The control unit 52 includes a CPU, a RAM, a ROM, and the like, and controls each component according to information processing. The control unit 52 includes an information acquisition unit (acquisition unit) 521, a dangerous road determination unit (dangerous area specification unit) 522, and a dangerous road information transmission control unit (transmission unit) 523.

Information Acquisition Unit 521

The information acquisition unit 521 acquires the signal indicating the location information of the dangerous driving, the signal indicating the time information of the dangerous driving, and the signal indicating the type of the dangerous driving, which are output from the plurality of information processing devices 200 via the communication unit 51. When the information acquisition unit 521 acquires each information above, the information acquisition unit 521 updates the dangerous driving occurrence information 531 indicating the location, time, and type of the dangerous driving that occurred. The dangerous driving occurrence information 531 is stored in the storage unit 53, and the dangerous driving occurrence information (location, time, and type) acquired in the past from the information processing device 200 is shown. When the dangerous driving occurrence information 531 is updated, the information acquisition unit 521 outputs a signal indicating that the dangerous driving occurrence information 531 is updated to the dangerous road determination unit 522.

Dangerous Road Determination Unit 522

The dangerous road determination unit 522 specifies (determines) a dangerous area according to the plurality of pieces of the location information of dangerous driving. The dangerous road determination unit 522 generates dangerous road information (dangerous area information) 533 indicating the specified dangerous area. The dangerous road determination unit 522 may generate and update the dangerous road information 533 using a reception of a signal indicating that the dangerous driving occurrence information 531 is updated as a trigger. The generated dangerous road information 533 is stored in the storage unit 53. The dangerous area indicated by the dangerous road information 533 is mapped to a map displayed to a user.

The dangerous road determination unit 522 determines whether or not the road shown in the map 532 stored in the storage unit 53 is a dangerous area. For example, the dangerous road determination unit 522 maps the location where the dangerous driving indicated by the dangerous driving occurrence information 531 occurred on the map 532. Then, the dangerous road determination unit 522 may rank the degree of danger in the area according to the number of dangerous driving occurrences in the predetermined area on the map 532. For example, the degree of danger of the area may be ranked in two stages, which are dangerous or not dangerous. Moreover, the degree of danger of the area may be ranked with a plurality of stages. The dangerous road information 533 may include the rank of each dangerous area.

For example, when the number of dangerous driving occurrences is equal to or greater than a predetermined number in a section where the major road distance is 1 km, the dangerous road determination unit 522 may determine that the section is a dangerous area (dangerous section). Further, when a determination target of the dangerous area is a local road, the determination target of the dangerous area may be an area or the like having a radius of 500*m* instead of a road zone.

In other words, according to the type of road that is the dangerous driving occurrence location, the range of the dangerous area is decided as a road section or a peripheral area including the road. According to the above configuration, the range of the dangerous area specified according to the type of road where dangerous driving occurred can be changed.

Further, the dangerous road determination unit 522 may specify a dangerous area for each type of dangerous driving. Moreover, the range specified as a dangerous area may be changed according to the type of dangerous driving. For example, when the dangerous driving is caused by speed limit excess, the vehicle performing the dangerous driving is likely to cause a danger in a wide range. Therefore, when the dangerous driving is caused by speed limit excess, the dangerous area may be specified from the location where the dangerous driving occurred to a location provided with a predetermined interval.

Further, the dangerous road determination unit 522 may specify the dangerous area according to the location where the dangerous driving occurred in a predetermined period, using the dangerous driving occurrence time indicated by the dangerous driving occurrence information 531.

For example, the dangerous area may be specified based on the location of dangerous driving that occurred within a period from the current time to one year ago. According to the above configuration, it is possible to specify a dangerous area in consideration of the recent trend of dangerous driving occurrence.

Further, the predetermined period may be a specific period such as a specific time zone (night time) or a large consecutive holiday period. According to above configuration, the area where dangerous driving is likely to occur in a specific period can be made into a dangerous area.

Update of Dangerous Road Information 533

When the information acquisition unit 521 newly acquires location information, the dangerous road determination unit 522 determines a dangerous area for the area including the location indicated by the location information. In the above determination, when there is a change or the like in ranking of the degree of danger of the area, the dangerous area information is updated according to the determination result.

Dangerous Road Information Transmission Control Unit 523

The dangerous road information transmission control unit 523 transmits dangerous road information 533 to the display device 6 via the communication unit 51 in response to a request from the display device 6. Note that when the dangerous road information 533 is already transmitted to the display device 6 in the past, only an updated portion of dangerous road information 533 from the dangerous road information 533 included in the display device 6 may be transmitted. Further, only dangerous road information 533 within a predetermined range from a place where the display device 6 is located may be transmitted. In this case, the dangerous road information transmission control unit 523 may determine whether or not there is a dangerous area in the predetermined range, and may transmit the dangerous road information 533 when the dangerous area exists in the predetermined range.

Storage Unit 53

The storage unit 53 stores the dangerous driving occurrence information 531, the map 532, the dangerous road information 533, and the like.

Configuration of Display Device 6

Figure 5:
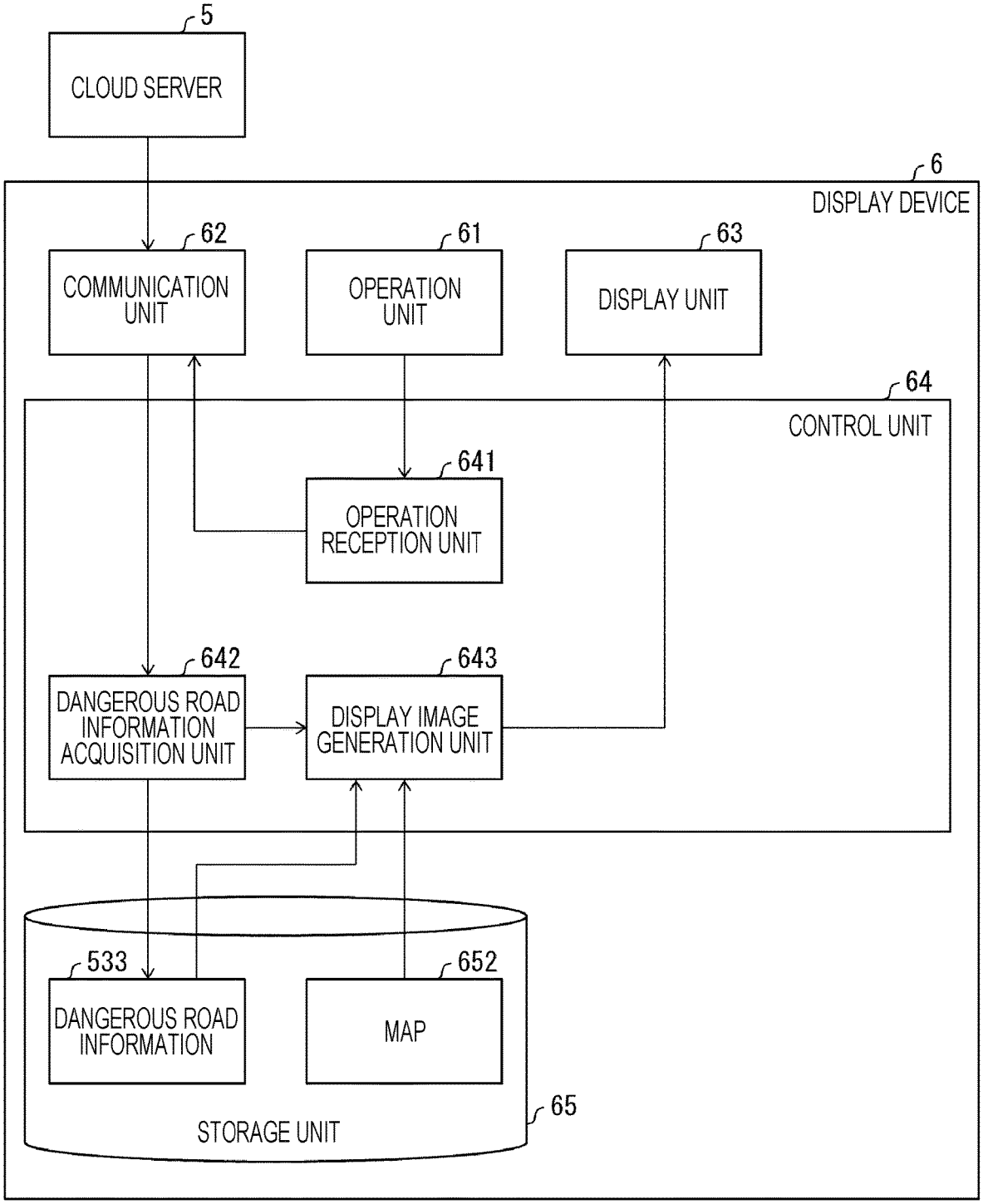
FIG. 5 is a block diagram showing an example of a major part configuration of a display device according to Embodiment 1 of the present disclosure.

Next, the configuration of the display device 6 will be described. FIG. 5 is a block diagram showing an example of a major part configuration of the display device 6. As shown in FIG. 5, the display device 6 includes an operation unit 61, a communication unit 62, a display unit 63, a control unit 64, and a storage unit 65.

Operation Unit 61

The operation unit 61 receives a user operation. In the present embodiment, in particular, an operation for displaying a map on which a dangerous area is mapped is received.

Communication Unit 62

The communication unit 62 communicates with an external device via a wide area communication network 4 or the like. In the present embodiment, in particular, the communication unit 62 communicates with the cloud server 5.

Display Unit 63

The display unit 63 is configured to display an image, and is realized by, for example, a liquid crystal display including a liquid crystal panel and a backlight unit. In the present embodiment, in particular, an image of a map on which a dangerous area is mapped is displayed.

Control Unit 64

The control unit 64 includes a CPU, a RAM, a ROM, and the like, and controls each component according to information processing. The control unit 64 includes an operation reception unit 641, a dangerous road information acquisition unit 642, and a display image generation unit 643.

Operation Reception Unit 641

The operation reception unit 641 receives a user operation for displaying a map on which the dangerous area is mapped via an operation unit 61. When the operation is received, the cloud server 5 is requested to transmit the dangerous road information 533 via the communication unit 62.

Dangerous Road Information Acquisition Unit 642

The dangerous road information acquisition unit 642 acquires the dangerous road information 533 via the communication unit 62 and stores the acquired dangerous road information 533 in the storage unit 65.

Note that when the display device 6 is already received the dangerous road information 533 in the past, only an updated portion of dangerous road information 533 from the dangerous road information 533 included in the display device 6 may be transmitted. In this case, the dangerous road information acquisition unit 642 updates the dangerous road information 533 stored in the storage unit 65 using the updated portion of the dangerous road information 533 which is already received. According to the above configuration, updating of dangerous area information and transmission of dangerous area information can be performed efficiently.

When the dangerous road information acquisition unit 642 stores the dangerous road information 533 in the storage unit 65 or instructs the display image generation unit 643 to generate a display image when the dangerous road information 533 stored in the storage unit 65 is updated.

Display Image Generation Unit 643

The display image generation unit 643 generates an image of map on which the dangerous area is mapped using dangerous road information 533 stored in the storage unit 65 and a map 652 that is map data, and causes the display unit 63 to display the image.

For example, the display image generation unit 643 may generate an image in which the dangerous area indicated by the dangerous road information 533 is displayed on a map for each type of dangerous driving.

According to the above configuration, a user can recognize a dangerous area where each kind of dangerous driving is likely to occur by confirming the image.

According to the configuration of the cloud server 5 described above, for example, a user can recognize a dangerous area where dangerous driving is likely to occur via the display device 6. Therefore, it can reduce that a user receives a damage from the dangerous driving due to other vehicles.

Processing Flow of Dangerous Area Display System 1

Next, an example of the processing flow of the dangerous area display system 1 will be described.

Processing Flow in Information Processing Device 200

Figure 6:
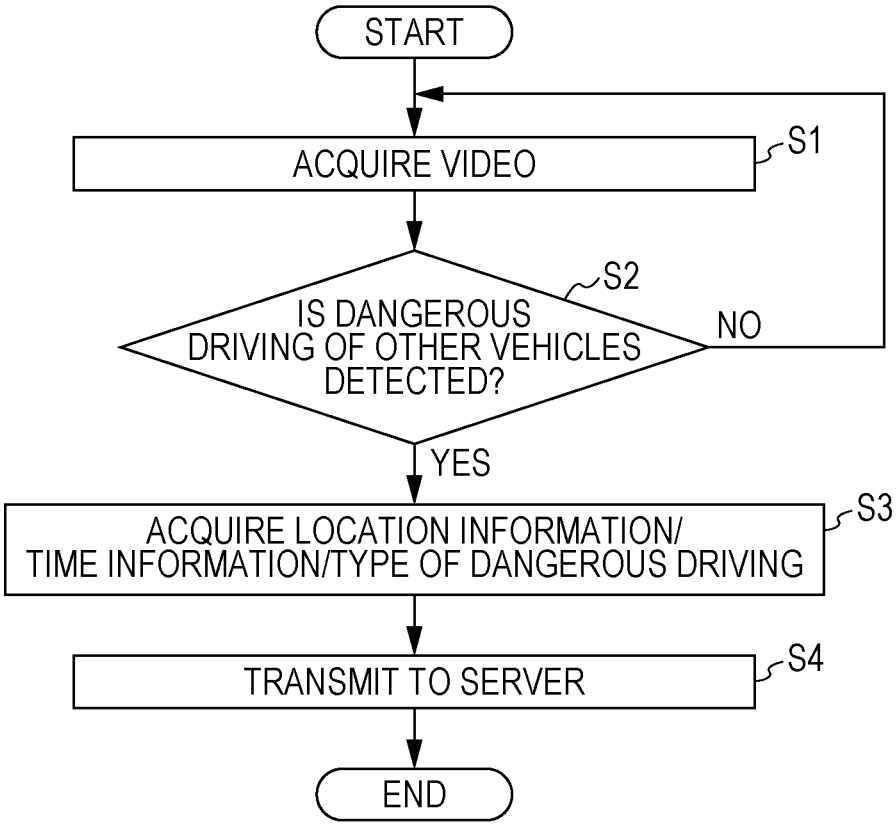
FIG. 6 is a flowchart showing an example of a processing flow in the information processing device according to Embodiment 1 of the present disclosure.

FIG. 6 is a flowchart showing an example of a processing flow in the information processing device 200. As shown in FIG. 6, a video acquisition unit 2011 acquires video data (S1). Subsequently, the dangerous driving determination unit 2013 determines (detects) dangerous driving of other vehicles (S2). When it is determined that the dangerous driving occurred (YES in S2), the dangerous driving information acquisition unit 2014 acquires the location information where the dangerous driving occurred, the time information when the dangerous driving occurred, and the type of the dangerous driving that occurred (S3: location information acquisition step, time information acquisition step, type determination step), and transmits the acquired information and type to the cloud server 5 (S4), thereafter the process is ended. Note that when it is determined that no dangerous driving occurred (NO in S2), the process returns to S1.

Processing Flow in Cloud Server 5

Figure 7:
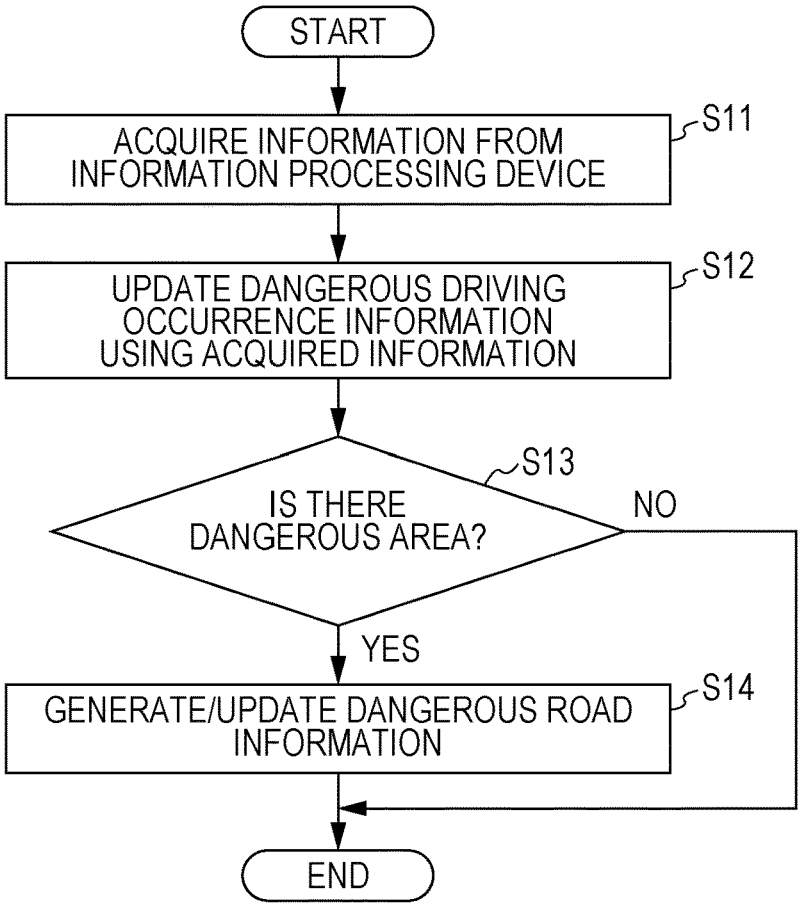
FIG. 7 is a flowchart showing an example of a processing flow in the cloud server according to Embodiment 1 of the present disclosure.

Next, the processing flow in the cloud server 5 will be described. FIG. 7 is a flowchart showing an example of a processing flow in the cloud server 5. As shown in FIG. 7, the information acquisition unit 521 acquires location information, time information, and the type of dangerous driving that occurred (S11). Subsequently, the information acquisition unit 521 updates the dangerous driving occurrence information 531 using the acquired information (S12). Subsequently, the dangerous road determination unit 522 determines whether or not there is a dangerous area by specifying the dangerous area (S13). When there is a dangerous area (YES in S13), the dangerous road determination unit 522 generates or updates the dangerous road information 533 (S14: generation step, updating step), and the process is ended. When there is no dangerous area (NO in S13), the process is ended.

Processing Flow in Display Device 6

Figure 8:
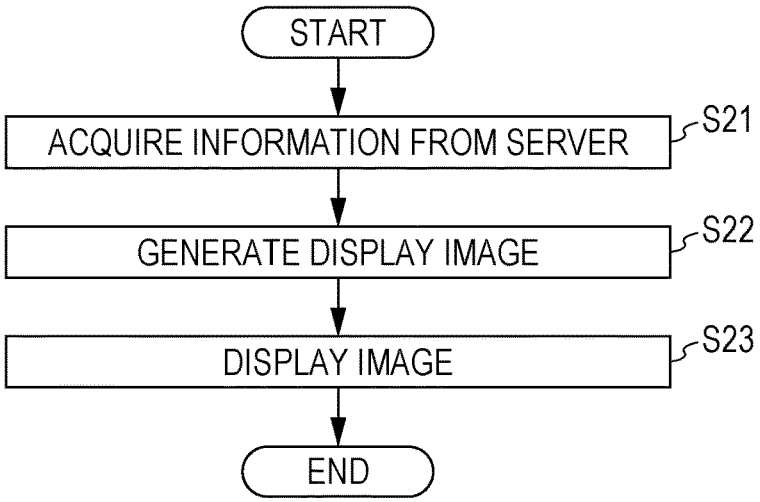
FIG. 8 is a flowchart showing an example of a processing flow in the display device according to Embodiment 1 of the present disclosure.

Next, the processing flow in the display device 6 will be described. FIG. 8 is a flowchart showing an example of a processing flow in the display device 6. As shown in FIG. 8, the dangerous road information acquisition unit 642 acquires the dangerous road information 533 from the cloud server 5 (S21). Subsequently, the display image generation unit 643 generates a display image (S22), and causes the display unit 63 to display the display image (S23: display step).

Example of Display Image

Next, a display image displayed on the display unit 63 of the display device 6 will be described with reference to FIG. 9. FIGS. 9A and 9B are diagrams which show an example of a display image showing a map on which a dangerous area displayed by the display device 6 is mapped.

Figure 9A:
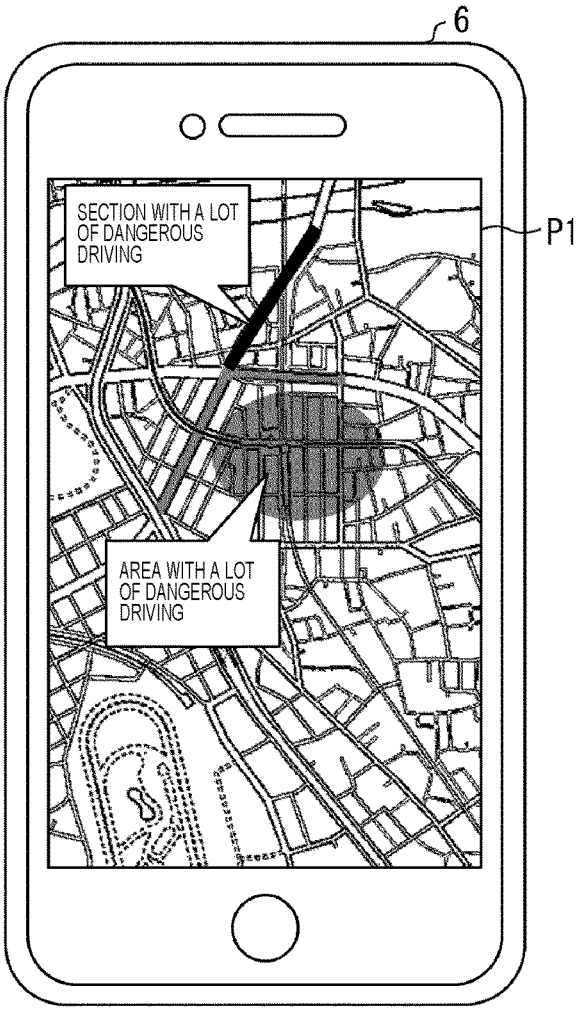
FIGS. 9A and 9B are diagrams showing an example of a display image displayed by the display device according to Embodiment 1 of the present disclosure.

A display image P1 shown in FIG. 9A is obtained by mapping the dangerous area indicated by the dangerous road information 533 on the map. For example, in the display image, each dangerous area may be displayed in different colors according to the rank of the dangerous area determined by the dangerous road determination unit 522. As shown in the display image P1, for the dangerous area in major roads, the corresponding section of the major road is displayed by color, and for the dangerous area in local roads, the corresponding area is displayed by color.

Further, the display image may indicate the type of dangerous driving occurring in the dangerous area.

Figure 9B:
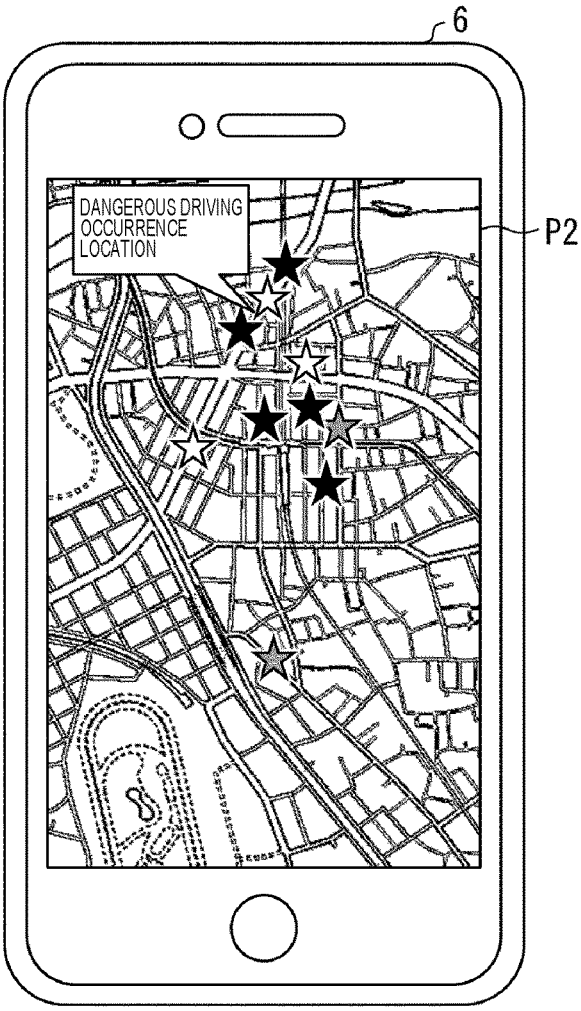

A display image P2 shown in FIG. 9B is obtained by mapping a point where dangerous driving occurred on a map as it is. That is, the dangerous road information 533 may include location information indicating the location where the dangerous driving occurred.

According to the above configuration, a driver can be alerted before the driver receives a damage from the dangerous driving such as violent driving by displaying to the driver a location where the dangerous driving occurred and a map image on which the dangerous area or the like with high frequency of occurrence of the dangerous driving is mapped.

Embodiment 2

Another embodiment of the present disclosure will be described below. For the convenience of explanation, regarding the member which has the same function as the member demonstrated in the above embodiment, the same reference sign is appended and the description is not repeated.

Dangerous Area Display System 1

The dangerous area display system 1 according to Embodiment 2 includes an information processing device 200, a cloud server 5, and a car navigation system (display device, car navigation device) 6*a*. Since the information processing device 200 and the cloud server 5 are the same as those described in Embodiment 1, the description thereof will not be repeated.

Figure 10:
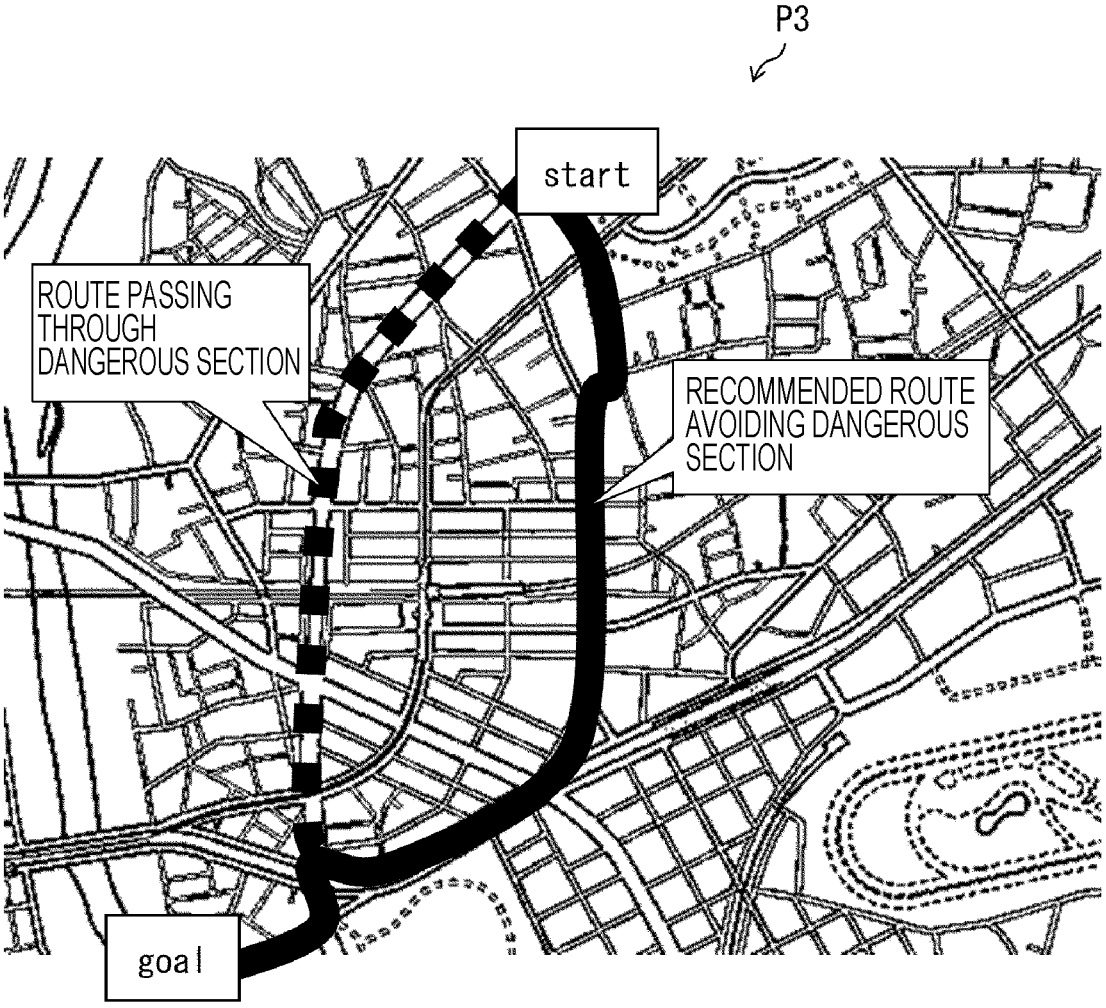
FIG. 10 is a diagram showing an example of a display image displayed by a car navigation according to Embodiment 2 of the present disclosure.

The car navigation 6*a* is a car navigation device, and displays a route that does not pass through the dangerous area specified by the cloud server 5 as a route to the destination. FIG. 10 is a diagram showing an example of a display image displayed by the car navigation 6*a*. As shown in FIG. 10, in the display image P3, a route avoiding the dangerous zone (area) is displayed as a recommended route. Note that, on the display image P3 shown in FIG. 10, for the sake of convenience of explanation, the route passing through the dangerous zone is indicated by a broken line, but it is assumed that the route indicated by the broken line is not displayed in the display image displayed by the car navigation 6*a*. According to the above configuration, it can reduce that a user receives the damage of dangerous driving by other vehicles.

Configuration of Car Navigation 6*a*

Figure 11:
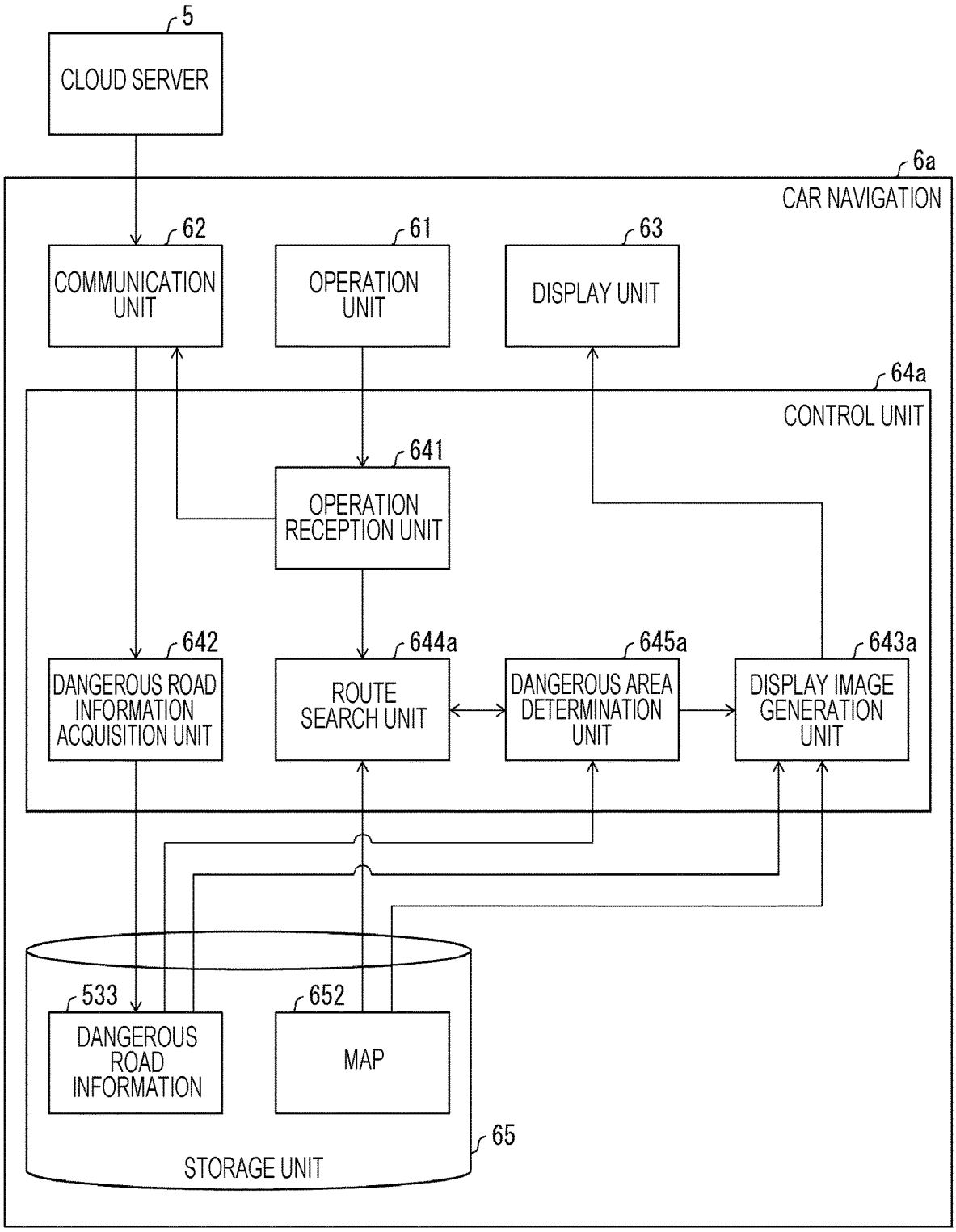
FIG. 11 is a block diagram showing an example of a major part configuration of the car navigation according to Embodiment 2 of the present disclosure.

Next, the configuration of the car navigation 6*a* will be described. FIG. 11 is a block diagram showing an example of a major part configuration of the car navigation 6*a*. As shown in FIG. 11, the car navigation 6*a* includes an operation unit 61, a communication unit 62, a display unit 63, a control unit 64*a*, and a storage unit 65. Note that the configuration of the communication unit 62 and the display unit 63 is the same as the configuration described in Embodiment 1, and thus description thereof will not be repeated.

Operation Unit 61

The operation unit 61 receives a user operation. In the present embodiment, in particular, an operation input for a route search including an operation input for a destination or the like is received.

Control Unit 64*a*

The control unit 64*a* includes a CPU, a RAM, a ROM, and the like, and controls each component according to information processing. The control unit 64*a* includes an operation reception unit 641, a dangerous road information acquisition unit 642, a display image generation unit 643*a*, a route search unit 644*a*, and a dangerous area determination unit 645*a*.

Operation Reception Unit 641

The operation reception unit 641 receives a user operation for route search via the operation unit 61. When the operation is received, the cloud server 5 is requested to transmit the dangerous road information 533 via the communication unit 62.

Dangerous Road Information Acquisition Unit 642

Here, only a configuration different from the dangerous road information acquisition unit 642 described in Embodiment 1 will be described. When the dangerous road information 533 is stored in the storage unit 65 or the dangerous road information 533 stored in the storage unit 65 is updated, the dangerous road information acquisition unit 642 according to the present embodiment instructs the route search unit 644*a* to search for a route.

Route Search Unit 644*a*

The route search unit 644*a* searches for a route from the destination and current location input by a user. For example, the route search unit 644*a* may search for a route to the destination from the destination and the current location input by the user with reference to a map 652 that is the map data stored in the storage unit 65. The route search unit 644*a* outputs information indicating the searched route to the dangerous area determination unit 645*a*.

Dangerous Area Determination Unit 645*a*

The dangerous area determination unit 645*a* determines whether or not there is a dangerous area on the route searched by the route search unit 644*a* using the dangerous road information 533 stored in the storage unit 65, the map 652 that is map data, and the like. In other words, the dangerous area determination unit 645*a* determines whether or not the route searched by the route search unit 644*a* is a route that passes through the dangerous area. When there is a dangerous area on the route searched by the route search unit 644*a*, the dangerous area determination unit 645*a* instructs the route search unit 644*a* to search for another route. When there is no dangerous area on the route searched by the route search unit 644*a*, the dangerous area determination unit 645*a* outputs a signal indicating the route to the display image generation unit 643*a*.

Display Image Generation Unit 643*a*

The display image generation unit 643*a* generates a display image on which a route avoiding the dangerous zone (area) is displayed using the route indicated by the signal received from the dangerous area determination unit 645*a*, the dangerous road information acquisition unit 642 and the map 652 stored in the storage unit 65, and the like, and causes the display unit 63 to display the display image. For example, a dangerous zone (area) may be displayed on the display image generated by the display image generation unit 643*a*.

Processing Flow in Car Navigation 6*a*

Figure 12:
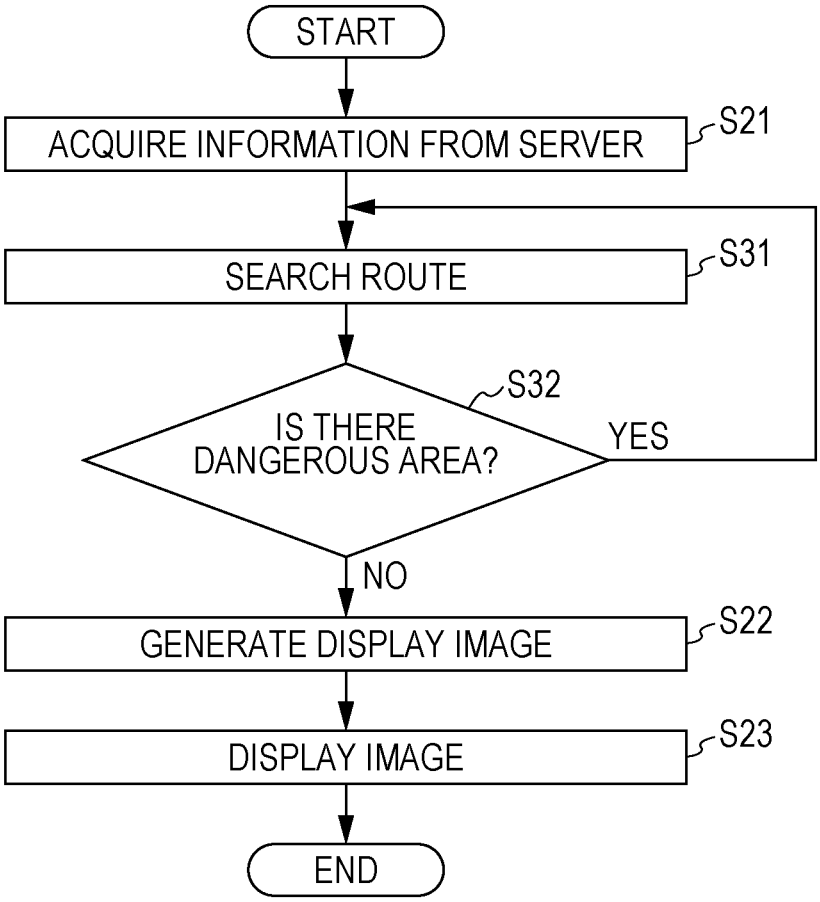
FIG. 12 is a flowchart showing an example of a processing flow in the car navigation according to Embodiment 2 of the present disclosure.

Next, a processing flow in the car navigation 6*a* will be described. FIG. 12 is a flowchart showing an example of a processing flow in the car navigation 6*a*. As shown in FIG. 12, the dangerous road information acquisition unit 642 acquires the dangerous road information 533 from the cloud server 5 (S21). Subsequently, the route search unit 644*a* searches for a recommended route to the destination (S31). The route search method is not particularly limited, and known technology can be used. Subsequently, the dangerous area determination unit 645*a* refers to the dangerous road information 533, and determines whether or not the recommended route searched in step S31 is a route that passes through the dangerous section or the dangerous area (S32). When the recommended route is not a route that passes through the dangerous section or the dangerous area (NO in S32), the display image generation unit 643*a* generates a display image (S22) and causes the display unit 63 to display the display image (S23), thereafter the process is ended. When the recommended route is a route that passes through a dangerous section or a dangerous area (YES in S32), the process returns to S31.

Implementation Example by Software]

The control blocks (control units 201, 52, 64, and 64*a*) of the information processing device 200, the cloud server 5, the display device 6, and the car navigation 6*a* device 10 may be realized by a logic circuit (hardware) formed in an integrated circuit (IC chip) or the like, or may be realized by software.

In the latter case, the information processing device 200, the cloud server 5, the display device 6, and the car navigation 6*a* device 10 include a computer that executes instructions of a program that is software that realizes each function. The computer includes, for example, at least one processor (control device) and at least one computer-readable recording medium storing the program. Further, in the computer, the processor reads the program from the recording medium and executes the program, thereby the object of the present disclosure can be achieved. As the processor, for example, a central processing unit (CPU) can be used. As the recording medium, a "non-temporary tangible medium"

such as a read only memory (ROM), a tape, a disk, a card, a semiconductor memory, a programmable logic circuit, or the like can be used. Further, a random access memory (RAM) or the like for expanding the program may be further provided. The program may be supplied to the computer via any transmission medium (such as a communication network or a broadcast wave) that can transmit the program. Note that one aspect of the present disclosure can also be realized in the form of a data signal embedded in a carrier wave, in which the program is embodied by electronic transmission.

SUMMARY

A system (dangerous area display system 1) according to Aspect 1 of the present disclosure includes an information processing device (200) that acquires location information indicating a location where dangerous driving occurred, which is determined from imaged data obtained by imaging a traveling vehicle, an information providing server (cloud server 5) that generates dangerous area information (dangerous road information 533) indicating a dangerous area specified according to a plurality of pieces of the location information acquired from the information processing device, and a display device (display device 6, car navigation 6*a*) that displays the dangerous area indicated by the dangerous area information on a map.

The system according to Aspect 2 of the present disclosure, in Aspect 1, the information processing device may acquire time information indicating a date-and-time when the dangerous driving occurred, and the information providing server may specify the dangerous area according to the location information of dangerous driving that occurred in a predetermined period using the time information acquired from the information processing device.

The system according to Aspect 3 of the present disclosure, in Aspect 1, the information processing device may determine a type of the dangerous driving from the imaged data, the information providing server may specify the dangerous area for each type of the dangerous driving determined by the information processing device, and the display device may display the dangerous area on the map for each type of the dangerous driving determined by the information processing device.

The system according to Aspect 4 of the present disclosure, in Aspect 1, the information providing server may decide a range of the dangerous area according to a type of a road at a location indicated by the location information.

The system according to Aspect 5 of the present disclosure, in Aspect 1, the information providing server may update the dangerous area information when the location information is newly acquired, and the display device may update the dangerous area information before update which is held in the display device using an updated portion of the dangerous area information.

The system according to Aspect 6 of the present disclosure, in Aspect 1, the display device may be a car navigation device (car navigation 6*a*), and the display device may display a route that does not pass through the dangerous area as a route to a destination.

The system according to Aspect 7 of the present disclosure, in Aspect 1, the imaged data obtained by imaging the traveling vehicle may be imaged data which is captured by at least one of an image capturing device installed in a vehicle that is damaged by the dangerous driving and an image capturing device installed at a location other than the vehicle that is damaged by the dangerous driving.

A system control method according to Aspect 8 of the present disclosure includes a location information acquisition step (S3) for acquiring location information indicating a location where dangerous driving occurred that is determined from imaged data obtained by imaging a traveling vehicle; a generation step (S14) for generating dangerous area information indicating a dangerous area specified according to a plurality of pieces of the location information acquired in the location information acquisition step; and a display step (S23) for displaying a map on which the dangerous area is indicated using the dangerous area information.

The system control method according to Aspect 9 of the present disclosure, in Aspect 8, the system control method may further include a time information acquisition step (S3) for acquiring time information indicating a date-and-time when the dangerous driving occurred, in which the dangerous area may be specified according to the location information of dangerous driving that occurred in a predetermined period using the time information acquired in the time information acquisition step.

The system control method according to Aspect 10 of the present disclosure, in Aspect 8, the system control method may further include a type determination step for determining a type of the dangerous driving from the imaged data, in which the dangerous area may be specified using the type of the dangerous driving determined in the type determination step (S3), and in the display step, the dangerous area may be displayed on a map for each type of the dangerous driving determined in the type determination step.

The system control method according to Aspect 11 of the present disclosure, in Aspect 8, in the generation step, a specified range of the dangerous area may be decided according to a type of a road at a location indicated by the location information.

The system control method according to Aspect 12 of the present disclosure, in Aspect 8, the system control method may further include a step of causing the information providing server to update the dangerous area information when the location information is newly acquired, and a step (S14) of causing a display device to update the dangerous area information before update which is held in the display device, using an updated portion of the dangerous area information.

The system control method according to Aspect 13 of the present disclosure, in Aspect 8, in the display step, a route that does not pass through the dangerous area may be displayed as a route to a destination on a car navigation device.

The system control method according to Aspect 14 of the present disclosure, in Aspect 8, the imaged data obtained by imaging the traveling vehicle may be imaged data which is captured by at least one of an image capturing device installed in a vehicle that is damaged by the dangerous driving and an image capturing device installed at a location other than the vehicle that is damaged by the dangerous driving.

An information providing server (cloud server 5) according to Aspect 15 of the present disclosure includes an acquisition unit (information acquisition unit 521) that acquires location information indicating a location where dangerous driving occurred, a dangerous area specification unit (dangerous road determination unit 522) that generates dangerous area information (dangerous road information 533) indicating a dangerous area specified according to a plurality of pieces of the location information, and a cloud server (dangerous road information transmission control unit 523) that transmits the dangerous area information to an external device (display device 6).

The present disclosure is not limited to the above-described embodiments, and various modifications can be made within the scope of the claims, and embodiments obtained by appropriately combining the technical units disclosed in different embodiments are also included in the technical scope of the present disclosure. Furthermore, new technical features can be formed by combining the technical units disclosed in each embodiment.

The present disclosure contains subject matter related to that disclosed in U.S. Provisional Patent Application No. 62/796,937 filed in the US Patent Office on Jan. 25, 2019, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A system comprising:

an image capturing device that captures an image of a travelling vehicle;

an information processing device mounted on the image capturing device, the information processing device including a video acquisition unit for acquiring video data obtained by capturing the image of the travelling vehicle by the image capturing device, a dangerous driving determination unit for determining whether dangerous driving by the travelling vehicle occurred, based on the video data acquired by the video acquisition unit, and a location information reception unit for receiving location information indicating a location where the dangerous driving occurred based on a satellite navigation system, upon reception of a signal indicating occurrence of the dangerous driving from the dangerous driving determination unit as a result of determination by the dangerous driving determination unit;

a cloud server that generates dangerous area information indicating a dangerous area specified according to a plurality of pieces of the location information acquired from the information processing device by communicating with the information processing device via a wide area communication network; and a display device in a vehicle other than the travelling vehicle that displays, by communicating with the cloud server via the wide area communication network, the dangerous area indicated by the dangerous area information on a map.

2. The system according to claim 1, wherein the information processing device acquires time information indicating a date-and-time when the dangerous driving occurred, and wherein the cloud server specifies the dangerous area according to the location information of dangerous driving that occurred in a predetermined period using the time information acquired from the information processing device.

3. The system according to claim 1, wherein the information processing device determines a type of the dangerous driving from the image, wherein the cloud server specifies the dangerous area for each of a plurality of types of dangerous driving determined by the information processing device, and wherein the display device displays the dangerous area on the map for each of a plurality of types of dangerous driving determined by the cloud server.

4. The system according to claim 1, wherein the cloud server determines a range of the dangerous area according to a type of a road at a location indicated by the location information.

5. The system according to claim 1, wherein the cloud server updates the dangerous area information when the location information is newly acquired, and wherein the display device updates the dangerous area information which is held in the display device, using an updated portion of the dangerous area information.

6. The system according to claim 1, wherein the display device is a car navigation device, and wherein the display device displays a route that does not pass through the dangerous area as a route to a destination.

7. The system according to claim 1, wherein the image obtained by imaging the traveling vehicle is an image which is captured by at least one of an image capturing device installed in a vehicle that is damaged by the dangerous driving and an image capturing device installed at a location other than the vehicle that is damaged by the dangerous driving.

8. A system control method for controlling a system including an image capturing device that captures an image of a travelling vehicle, an information processing device mounted on the image capturing device, a cloud server that generates dangerous area information indicating a dangerous area specified according to a plurality of pieces of location information acquired from the information processing device by communicating with the information processing device via a wide area communication network, and a display device in a vehicle other than the travelling vehicle that displays, by communicating with the cloud server via the wide area communication network, the dangerous area indicated by the dangerous area information on a map, the system control method comprising:

capturing an image of the travelling vehicle;

processing information by the image processing device, including determining whether dangerous driving by the travelling vehicle occurred, based on the video data obtained during the capturing of the image of the travelling vehicle, and receiving the location information indicating a location where the dangerous driving occurred based on a satellite navigation system, upon determining that the dangerous driving by the travelling vehicle occurred;

generating dangerous area information indicating a dangerous area specified according to the plurality of pieces of location information acquired during information processing by the image processing device; and displaying a map on which the dangerous area is indicated using the dangerous area information.

9. The system control method according to claim 8, further comprising:

acquiring time information indicating a date-and-time when the dangerous driving occurred, wherein the dangerous area is specified according to the location information of dangerous driving that occurred in a predetermined period using the time information acquired indicating the date-and-time when dangerous driving occurred.

10. The system control method according to claim 8, further comprising:

determining a type of the dangerous driving from the image, wherein the dangerous area is specified using the type of the dangerous driving determined, and wherein in displaying a map on which the dangerous area is indicated, the dangerous area is displayed on a map for each type of the dangerous driving determined.

11. The system control method according to claim 8, wherein in generating the dangerous area information, a specified range of the dangerous area is determined according to a type of a road at a location indicated by the location information.

12. The system control method according to claim 8, further comprising:

causing the cloud server to update the dangerous area information when the location information is newly acquired; and causing a display device to update the dangerous area information which is held in the display device, using an updated portion of the dangerous area information.

13. The system control method according to claim 8, wherein in displaying a map on which the dangerous area is indicated, a route that does not pass through the dangerous area is displayed as a route to a destination on a car navigation device.

14. The system control method according to claim 8, wherein the image obtained by imaging the traveling vehicle is an image which is captured by at least one of an image capturing device installed in a vehicle that is damaged by the dangerous driving and an image capturing device installed at a location other than the vehicle that is damaged by the dangerous driving.

15. A cloud server comprising:

an acquisition unit that acquires, by communicating via a wide area communication network with an information processing device mounted on an image capturing device that captures an image of a travelling vehicle, location information indicating a location where dangerous driving occurred from the information processing device;

a dangerous area specification unit that generates dangerous area information indicating a dangerous area specified according to a plurality of pieces of the location information; and a transmission unit that transmits the dangerous area information to an external device, the information processing device including a video acquisition unit for acquiring video data obtained by capturing the image of the travelling vehicle by the image capturing device, a dangerous driving determination unit for determining whether dangerous driving by the travelling vehicle occurred, based on the video data acquired by the video acquisition unit, and a location information reception unit for receiving the location information indicating the location where the dangerous driving occurred based on a satellite navigation system, upon reception of a signal indicating occurrence of the dangerous driving from the dangerous driving determination unit as a result of determination by the dangerous driving determination unit.

* * * * *